United States Patent [19]

Bloom

[11] 4,416,624

[45] Nov. 22, 1983

[54] VERTICAL TUNNEL KILN

[75] Inventor: Terry R. Bloom, Middlebury, Ind.

[73] Assignee: CTS Corporation, Elkhart, Ind.

[21] Appl. No.: 325,111

[22] Filed: Nov. 27, 1981

[51] Int. Cl.[3] ..... F27B 9/14

[52] U.S. Cl. ..... 432/134; 34/164; 219/378; 414/209; 414/210; 414/216

[58] Field of Search ..... 432/134; 34/164; 414/209, 210, 216; 406/83, 192; 222/278; 219/388; 373/109, 111, 113

[56] References Cited

U.S. PATENT DOCUMENTS

| | | | |
|---|---|---|---|
| 929,765 | 8/1909 | Horn | 432/61 |
| 1,043,158 | 11/1912 | Simmons | 432/134 |
| 2,007,009 | 7/1935 | Staples | 373/113 |
| 2,061,358 | 11/1936 | Hunter et al. | 414/210 |
| 2,611,601 | 9/1952 | Knight | 432/134 |
| 3,469,831 | 9/1969 | Beavers | 432/134 |
| 3,868,213 | 2/1975 | Shulika et al. | 432/134 |
| 3,890,011 | 6/1965 | Futer | 406/88 |
| 4,237,622 | 12/1980 | Francis | 34/164 |

FOREIGN PATENT DOCUMENTS

| | | | |
|---|---|---|---|
| 838826 | 6/1960 | United Kingdom | 432/134 |
| 1233012 | 5/1971 | United Kingdom . | |
| 626888 | 10/1978 | U.S.S.R. | 432/134 |

*Primary Examiner*—John J. Camby

*Attorney, Agent, or Firm*—Larry J. Palguta; John A. Young

[57] ABSTRACT

A vertical tunnel kiln (10) comprising a firing kiln (30) having a interior core (42) supporting a spiral chute (46) attached to the periphery of the core (42). A vibratory bowl feeder (20) automatically feeds parts (100) individually to the upper end (24) of the spiral chute (46), and the parts (100) progress down the chute by means of vibrations imparted to the interior core (42) and chute (46) by a vibratory mechanism (40) attached to the annular base (47). Heating elements (38) and (70) are disposed exteriorly and interiorly, respectively, about the interior core (42) to produce a temperature gradient. As the parts (100) advance along chute 46, resistive materials on the parts (100) are heated in the preheat section (54) to remove volatile organic materials, fired in the intermediate portion (55) of the firing kiln (30), and then cooled in the cooling portion (56). The parts (100) are removed individually by an escapement mechanism (80) attached to the lower end of the spiral chute (46).

16 Claims, 5 Drawing Figures

VERTICAL TUNNEL KILN

DESCRIPTION

1. Technical Field

The present invention relates to kilns utilized for the firing of thick film materials such as resistors and resistor networks, wherein the thick film material is heated to a temperature sufficient not only to remove volatile organics from the resistive paint but to bond the resistive material to the underlying substrate.

2. Background Art

The prior art includes many types of tunnel kilns utilized for firing thick film materials. One type of tunnel kiln is the Harrop Precision Furnace which can be up to sixty feet in length. Thick film materials may be screen printed in patterns on substrates, then placed on saggers or boards which are positioned in seriatim on a metal conveyor belt moving through the tunnel kiln. Most tunnel kilns utilized for this type of firing treatment, consist of a firing section and a cooling section. However, some tunnel kilns such as the Harrop Precision Furnace utilize a separate preheat section for removing volatile organics from resistive paints and thereby remove these contaminants prior to the thick film materials entering the firing section of the furnace. It takes approximately forty-five to sixty minutes for parts to progress through a tunnel kiln, depending on the type of parts to be fired. The energy requirement of such a tunnel kiln is about 250 kilowatts per hour.

Various designs have been utilized in order to reduce the size of various types of furnaces or hearths. Schoenlaub U.S. Pat. No. 3,433,468 issued May 18, 1969 discloses an apparatus having a plurality of hearth plates disposed in vertically spaced overlapping relation, with reciprocating plates moveably mounted to push the load from one hearth plate to the next. White U.S. Pat. No. 3,258,852 issued July 5, 1966 describes a material handling apparatus utilizing a helical track having connections at each end of the track in order to facilitate the inlet and outlet flow of a heat exchange fluid. Zimmer et al. U.S. Pat. No. 4,072,093 issued Feb. 7, 1978 and Guibert U.S. Pat. No. 3,847,069 issued Nov. 12, 1974, both describe food ovens having a heatable oven chamber, an annular helical track way, and components for advancing and imparting epicyclic movement of circular food packages as they progress along the track way. Petit U.S. Pat. No. 2,667,452 issued Jan. 26, 1954 describes a fuel devolatilizing apparatus having a vibrator operatively connected to a spiral chute for transmitting fuel along the chute. Sauer et al. U.S. Pat. No. 4,048,472 issued Sept. 13, 1977 describes a vibratory spiral conveyor having an expanded metal resistance heater element positioned between adjacent turns of the spiral conveyor. Czerny et al. U.S. Pat. No. 4,035,151 issued July 12, 1977 discloses a vibratory spiral conveyor chute having a mixing ramp arrangement provided in the chute. Also, dryers for drying resistive material screened on substrates have been utilized. These dryers consist of a cylindrical aluminum tube having a spiral track machined in the tube, a heater located inside the tube, and a vibratory mechanism mounted below the tube and for causing the substrates to advance upwardly on the track. The dryers operate at a low temperature of about 200° C., do not have any mechanisms to control the speed of parts progressing through the dryer, and have been difficult to adjust and maintain. While the prior art discloses various types of vibratory apparatus, spiral conveyor chutes, heating ovens and dryers, there is not disclosed a method or apparatus suitable as a tunnel kiln for firing resistive materials.

It is desirable to provide a tunnel kiln of a much smaller size than the prior art kilns which range from ten to sixty feet in length, so that the smaller kiln requires only a fraction of the energy requirements of the larger tunnel kilns, and which has greater reliability for effecting closer control of the kiln firing atmosphere and the load or mass of parts moving through the kiln.

DISCLOSURE OF THE INVENTION

The present invention comprises a vertical tunnel kiln which is substantially smaller in size than prior art tunnel kilns; requires only a fraction of prior art energy requirements, and has a high degree of reliability for controlling the kiln atmosphere, temperature, and the load handled by the kiln. The vertical tunnel kiln comprises an interior core having a helical chute attached to the exterior of the core, the core and helical chute being located within an exterior casing containing heating elements positioned peripherally about the helical chute. A vibratory bowl feeder supplies parts singularly to the top end of the helical chute, and an escapement mechanism utilizing a step-and-hold method removes the parts individually from the bottom end of the chute. The core and helical chute are positioned on top of a vibratory mechanism for imparting vibration to the chute to transmit parts along the helical chute from the upper end to the lower end. The upper portion of the interior core has apertures for increasing the flow of air in the preheat section of the kiln. Baffles are located near the top and the bottom of the interior core in order to restrict the flow of atmosphere through the vertical tunnel kiln, and to maintain a high temperature range within the intermediate section of the kiln. The baffles control a "chimneying" effect for the removal of contaminants from the preheat portion of the vertical tunnel kiln, while the apertures disposed in the upper section of the interior core promote a more turbulent air flow for the removal of volatiles. An escapement mechanism at the bottom of the kiln operates to remove parts individually, and the rate regulates the time required for an individual part to traverse from the upper to the lower end of the helical chute.

The vertical tunnel kiln attains the objectives of being greatly reduced in size so that the kiln requires only a fraction of the space required by a prior art tunnel kiln. The energy requirements for the vertical tunnel kiln are, correspondingly, a fraction of that required by prior art tunnel kilns, and there is a high degree of reliability in the (1) there are fewer temperature zones within the kiln and the respective zones can be more closely controlled, (2) the atmosphere within the kiln can be closely controlled, and (3) the mass of the parts tracking through the kiln from the upper to the lower end can be closely controlled. Thus, the objectives as to space, energy, and reliability are accomplished by the vertical tunnel kiln such that the part yield can be increased and the quality of the parts can be more closely controlled.

BEST MODE FOR CARRYING OUT THE INVENTION

Figure 1:
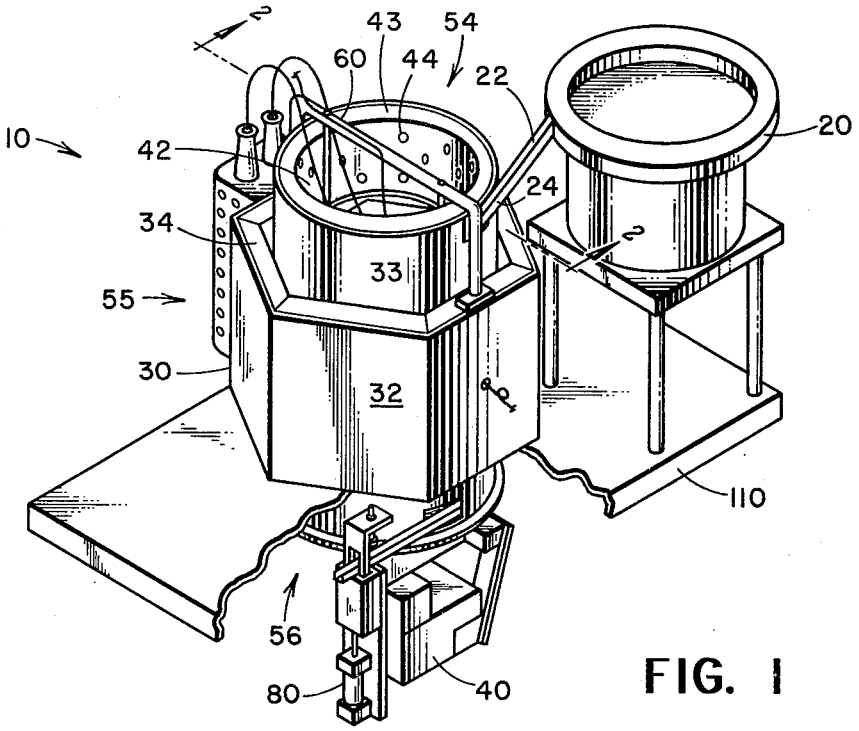
FIG. 1 is a isometric view of the vertical tunnel kiln of the present invention.
Figure 2:
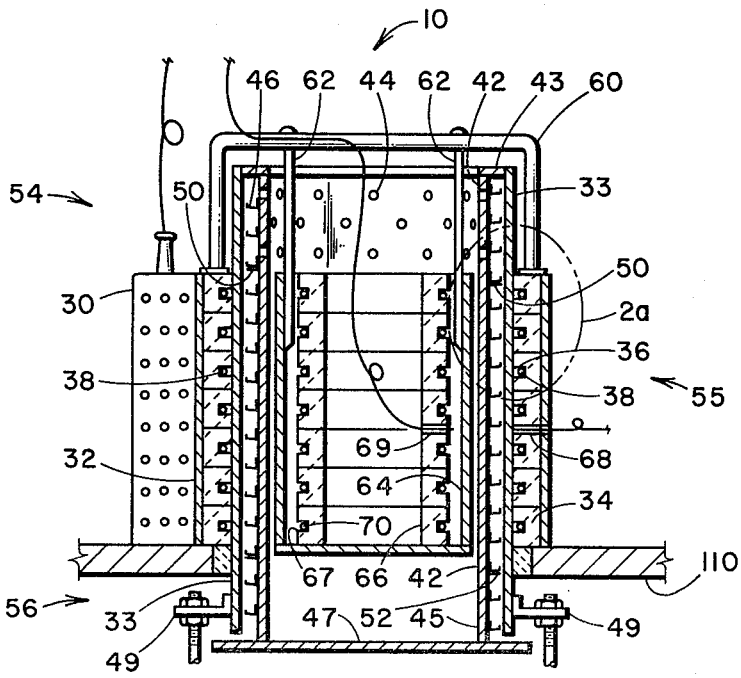
FIG. 2 is a section view along view line 2—2 of FIG. 1.

Referring now to the drawings, and particularly FIGS. 1 and 2, the vertical tunnel kiln is designated generally by reference numeral 10. The main components of the vertical tunnel kiln 10 are a vibratory bowl feeder 20, a firing kiln 30, a vibratory mechanism 40, and a escapement mechanism 80. The vibratory bowl feeder 20 is a standard Syntron bowl feeder manufactured by the Syntron Company of Homer City, Pa. The parts to be fired are placed inside the vibratory bowl, and the feeder aligns each of the parts in a predetermined position at the exit portion of the vibratory bowl feeder, wherein the parts exit via the track way 22 and enter the chute end 24.

Figure 2A:
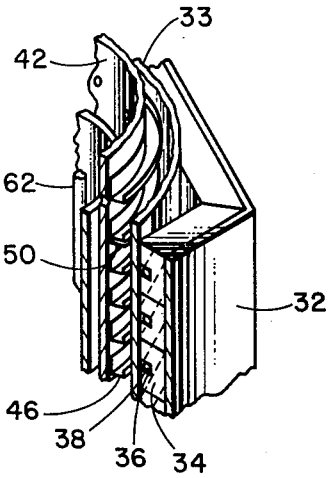
FIG. 2A is an enlarged isometric view of the circled area of FIG. 2.

The firing kiln 30 comprises an exterior casing 32 and insulating fire bricks 34 disposed about the inner periphery of the casing 32. The fire bricks 34 have an interior groove 36 located in each brick for support of the exterior heating element 38. The exterior heating element 38 is connected to exterior wiring (not shown) for providing an electrical current to the heating element. The exterior casing 32 and fire bricks 34 are disposed about a muffle 33 and an interior core 42. The muffle 33 protects the heating element 38 from contaminants emitted by the paints being fired in the firing kiln 30. The muffle 33, interior core 42, and other metal components located within the interior of the kiln, must consist of a high temperature alloy capable of withstanding temperatures at least as high as 1,000° C., and which will not deteriorate over an extended period of use. Thus, the interior metallic components are made of Inconel which is a special alloy suitable for this use. The core 42 is cylindrical in shape, and has a plurality of apertures 44 disposed in the upper portion. Secured to the perimeter of the interior core 42, is a spiral chute 46, also made of Inconel, and for carrying and transmitting the parts through the firing kiln. The spiral chute 46 is attached to the top of the cylinder at core end 43, and, as illustrated in FIG. 2A, winds around the exterior of the core in a spiral path to the bottom of the interior core at core end 45.

Also disposed about the perimeter of the interior core 42, is a set of spaced baffles 50 and 52. The upper baffle 50 (see FIG. 2A) is located approximately $\frac{1}{3}$ of the length of the interior core 42 from core end 43, while the lower baffle 52 is located approximately $\frac{1}{4}$ of the length of the interior core 42 from core end 45. The baffles restrict the flow of atmosphere through the firing kiln 30, thereby closely controlling the "chimneying" effect caused by the movement of atmosphere through the kiln as heat rises upwardly. The control of the movement of atmosphere through the kiln increases the ability to maintain the proper temperature gradient in the kiln and particularly in the high temperature portion of the kiln which is designated generally by reference numeral 55.

The intermediate portion 55 of the firing kiln 30 is that portion wherein the thick film materials are fired. The upper portion of the firing kiln 30, and designated generally by reference numeral 54, is the preheat section wherein volatile organic materials are released by the heated resistive materials and removed by convection. The lower portion of the kiln, designated generally by reference numeral 56, is the cooling section of the firing kiln 30, wherein the parts are quickly cooled after having been fired so that the resistive paint materials or conductives will not oxidize after leaving the intermediate portion or firing section 55. Positioned over the top of the firing kiln 30, is frame 60 which supports, by rods 62, an innermost core 64 also consisting of Inconel. The innermost core 64 is cylindrically shaped and supported therein is a stack of fire bricks 66 having perimeter slots 67 forming a spiral path. Located within the slots 67 of fire bricks 66 is an interior heating element 70 operatively connected to an exterior power source. By being positioned within innermost core 64, interior heating element 70 is effectively protected from any contaminants within the kiln. The innermost core 64, fire bricks 66, and interior heating element 70, provide heating at the interior of the kiln 30.

It should be understood that while the preferred embodiment describes interior and exterior heating elements 70 and 38, that only one heating element is actually required. An exterior heating element 38, of sufficient wattage capability, will be sufficient to heat the kiln if the interior of the kiln 30 is insulated to limit the flow of atmosphere through the kiln and accomplish the proper chimneying affect. In the alternative, only the intermost core 64 with interior heating element 70 of sufficient wattage capability, may be utilized to heat the kiln 30 while the exterior of the kiln is properly insulated. Thus, the heating means for the kiln can be positioned about the exterior of the kiln or located in the interior of the kiln, as long as the complementary section of the kiln is properly insulated and a heating element of sufficiently high wattage is used. Additionally, heating elements 38 and 70 may each comprise a plurality of separate heating elements so that the temperatures in the kiln sections can be varied to product greater temperature differentials, if desired or needed.

The spiral chute 46, consisting of Inconel, may be a solid chute or can be a plurality of wires forming a spiral chute. It has been found that a solid U-shaped chute is preferable to a plurality of wires for supporting the parts, because there are fewer chances for the parts to be "hung up" by pieces of solder or irregularities in the wires.

The interior core 42 is supported by annular base 47 (made of Inconel) which is mounted upon the vibratory mechanism 40. Muffle 33 is independently supported by brackets 49. The vibratory mechanism 40 imparts a vibration to interior core 42 and spiral chute 46, such that the parts to be fired, upon entering track chute end 24 from vibratory bowl feeder 20, will be transmitted along spiral chute 46 from interior core end 43 to core end 45.

An exterior thermal couple 68 is inserted through the fire bricks 34 for mounting the heat produced by heating element 38. Likewise, an interior thermal couple 69 within intermost core 64 determines the temperature produced by heating element 70. The outputs of thermal couples 68 and 69 enable a comparison of the temperatures produced by the heating elements 38 and 70, and thus a balancing of these temperatures may be accomplished to attain the proper temperature gradient within the firing kiln 30.

Figure 3:
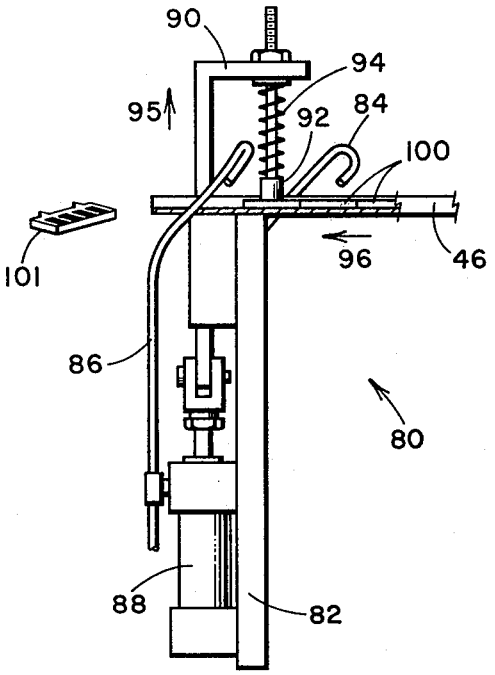
FIG. 3 is an enlarged view of the escapement mechanism in operation.

Referring now to FIG. 3, there is located at the bottom of the firing kiln 30, and attached to the bottom portion of the spiral chute 46, an escapement mechanism designated generally by reference numeral 80. The escapement mechanism comprises a support post 82, compressed air nozzles 84, 86, solenoid actuator 88, reciprocating arm 90, part holder 92, and spiral spring 94. As the parts 100 exit the cooling section 56 of the firing kiln 30, they advance along the chute 46 in end-to-end alignment where they will then be ejected via a step-and-hold method. The reciprocating arm 90 is attached to the solenoid 88, the arm 90 having the part holder 92 located at an end thereof and biased downwardly by the spiral spring 94. When the solenoid actuator 88 moves the arm 90 in the direction of arrow 95, a jet of air is released from the air nozzle 84 and the last two parts are advanced in the direction of arrow 96. The actuator 88 then moves the arm 90 in a downwardly direction opposite arrow 95, and the part holder 92 engages the next to the last part 100. At this point, the next to the last part 100 is held while the parts behind it are also stopped momentarily. A jet of air is released from the air nozzle 86 which causes the last part 101 to be ejected from the end of chute 46. The escapement mechanism 80 then cycles through the same operational procedure whereby the solenoid actuator 88 again raises the arm 90 which also raises the holder 92, and a jet of air from nozzle 84 advances the last two parts into position for the subsequent ejection of the last part 101 by a jet of air from the nozzle 86. The solenoid actuator and associated parts are controlled by an electric timer mechanism (not shown) which coordinates the operation of the mechanical parts and compressed air expulsion.

The vertical tunnel kiln 10 is much smaller in size than the typical ten to sixty foot tunnel kilns utilized for firing resistive materials. The entire vertical tunnel kiln and its support table 110 are approximately five foot in height, and occupy an area of approximately twelve square foot.

OPERATION

The vertical tunnel kiln is operated by coordinating the operational speeds of its various parts. First, the vibratory bowl feeder 20 feeds parts 100 individually through track way 22 to chute end 24 of spiral chute 46. The vibratory mechanism 40 operates at sixty cycles per second, or 7,200 cycles per minute. The mechanism 40 imparts vibration to the interior core 42 and spiral chute 46 attached thereto. This causes the parts 100 to be transmitted from the upper to the lower end of spiral chute 46.

When the escapement mechanism 80 causes some of the parts 100 to cease to move downwardly along the spiral chute, specifically those parts 100 located at the bottom few turns of the sprial chute 46, the parts do not abut end-to-end and cause a piling up or spilling over of parts. Quite the contrary, when the parts 100 stop moving forward they vibrate radially outwardly and abut the outer perimeter wall of the spiral chute 46. Thus, there is a self-braking effected by each part thereby causing the parts to be held in place and not pile up one upon the other or fall off the track.

The escapement mechanism 80 is operated in a proper timing sequence with the vibratory mechanism 40, such that the parts 100 advance through the firing kiln 30 in a predetermined period of time. It takes approximately forty-five minutes for a part to be transmitted from the upper end to the lower end of chute 46 and be removed by escapement mechanism 80. This time is sufficient for the proper firing processes to be completed. As many as 2,000 parts per hour may be cycled through the vertical tunnel kiln 10.

The upper portion or preheat section 54 of the kiln 10, does not have any heating elements disposed thereabout. There is a sufficient chimneying affect created by the draft of air moving upwardly through the firing kiln 30, to remove by convection the volatiles contaminating the atmosphere of the preheat section. The apertures 44 assist in creating more of a turbulent flow of air in the preheat section to effect removal of contaminated atmosphere. Likewise, no cover is needed for the kiln because of the controlled flow of atmosphere through the kiln.

The parts 100 enter the spiral chute 46 at end 24, and progress through the preheat section that is heated to a temperature of approximately 300° C. (see FIG. 4, Curve 2 at time 0). The intermediate portion 55 or firing section of the firing kiln 30 is rated at 1,000° C. The temperatures in this high temperature zone may vary but are typically in the range of 600° C. to 900° C. for firing resistive and other thick film materials. The cooling section or lower portion 56 of the kiln 10, is heated to a temperature of approximately 220° C. It is important that the proper temperature gradient be maintained within the kiln 10, so that the parts 100 are each exposed to the same temperatures as they advance through the kiln. It is desirable that there be a quick temperature drop in the cooling section 56 so that when conductives are being heated they will not oxidize in the 650° C. to 750° C. range. Therefore, it is necessary that the temperature drop quickly in the range of approximately 800° C. to 600° C., in order to prevent this oxidation. This is accomplished by producing a temperature gradient which will effect a drop of approximately 50° C. per minute as the parts advance through to cooling section 56.

Figure 4:
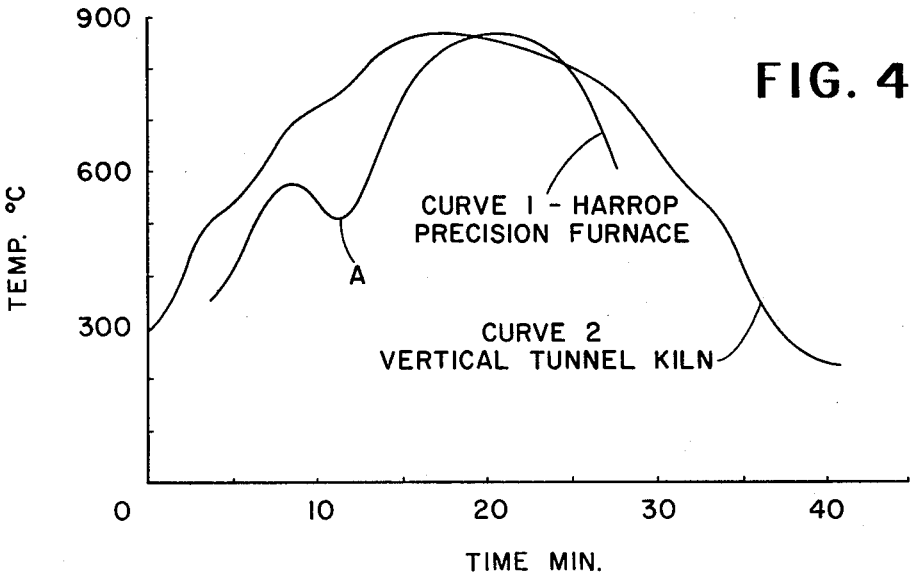
FIG. 4 illustrates the temperature profiles attained by a prior art furnace and the vertical tunnel kiln.

Referring now to FIG. 4, there is illustrated a graph showing the temperatures attained by a prior art furnace and the vertical tunnel kiln. Curve 1 represents a temperature profile of a Harrop Precision Furnace. The dip in the curve at point A represents the separation between the preheat section and the firing section of the furnace, the preheat section being used to remove volatile organic materials from the paint, thereby preventing these contaminants from being present in the atmosphere within the firing section. Curve 1 illustrates that the preheat section removes volatile organic material by heating the resistive material within the range of approximately 300° C. to 500° C. The firing section reaches a temperature of approximately 860° C. after a part has progressed through the preheat section and into the firing section of the furnace in approximately twenty-one minutes. There is a sharp drop in the temperature profile as the parts enter the cooling section of the Harrop furnace. The temperature drops from approximately 850° C. to 600° C. in a four minute time span (time twenty-three minutes to time twenty-eight minutes). This sharp drop in the temperature obviates the aforementioned oxidation that may occur in the temperature range of 650° to 750° C.

Curve 2 of FIG. 4 represents the temperature profile developed by the vertical tunnel kiln 10 in a "load" condition wherein parts are cycled through the kiln 10. The parts enter the kiln 10 at time zero and are exposed to a preheat temperature of approximately 300° C. which increases as the parts advance through the preheat section 54 of the kiln. The parts then advance through the firing section 55 and are exposed to a temperature of approximately 870° C. at the seventeen minute mark. The parts enter the cooling section 56 and are exposed to a declining temperature decreasing at a rate sufficient to prevent oxidation of the materials, i.e., approximately 50° C./minute. That portion of the curve is illustrated between the twenty-eight minute and thirty-nine minute marks. To assist in accomplishing this temperature drop, no insulation is used about the cooling section of the kiln.

The escapement mechanism 80, operates at a predetermined speed in order to control the movement of the parts through the kiln. The movement of the parts through the kiln is controlled by varying the ejection rate of parts via the escapement mechanism 80, and the operation of the vibratory mechanism 40. Thus, the speed of the parts advancing along the spiral chute 46 may be altered by changing the frequency of the vibrations effected by the vibratory mechanism 40, or by altering the ejection rate effected by the escapement mechanism 80, or by adjusting both the frequency of the vibrations and the ejection rate of the escapement mechanism.

The vertical tunnel kiln can fire as many as 2,000 parts per hour, which is approximately one half the output of an automatic screening machine that screens resistive material onto substrates at a rate of approximately 4,000 substrates per hour. The output of the vertical tunnel kiln can be increased by simply adding another spiral chute next to the existing chute 46 and thereby doubling the output with little increase in the energy required for firing the parts. Also, the double track vertical tunnel kiln could process the output of an automatic screening machine whose parts are fed, after drying, to the vibratory bowl feeder.

The energy requirements for the vertical tunnel kiln are but a fraction of prior art tunnel kiln energy requirements. The vertical tunnel kiln requires about 25 kilowatts per hour for operation, which is approximately 10 to 20 percent of the energy requirement of a prior art tunnel kiln. As mentioned above, the addition of another spiral chute will enable the kiln to double its yield, and this can be accomplished with minimal affect upon the energy requirement of 25 kilowatts per hour. Larger prior art tunnel kilns do not operate at full load all of the time. That is, as the parts enter and cycle through a longitudinal tunnel kiln, the energy requirement increases and changes as the load is applied to the kiln. The vertical tunnel kiln of the present invention cycles parts along the chute in continuous end-to-end relationship such that the kiln is continually operating at approximately eighty percent of its maximum energy requirement. Thus, a more constant control of the mass or load being applied to the oven is achieved and thus the temperature gradient effected in the kiln can be more closely controlled.

Substrates having resistive networks screened thereon have been fired in the vertical tunnel kiln and the fired resistance values of the resistors are within approximately 4% of the resistance values of resistors fired in the Harrop Precision Furnace. This slight variance in the fired resistance value can be improved by making further adjustments which will refine the temperature profile in the kiln.

The vertical tunnel kiln achieves a significant reduction in the space required for a production firing kiln, substantially reduces the energy requirements necessary for filing resistive materials, and increases the reliability of the kiln by allowing closer control of the atmosphere and temperature zones within the kiln and the load progressing through the kiln. Such a firing kiln will lend itself readily to a computerized feedback loop system wherein a computer receives inputs from various sensors and in accordance with the information received, the computer alters the rate of progress of the parts through the kiln, changes the temperature profile effected within the kiln and coordinates these variables to increase the yield.

CONCLUSION

Although the present invention has been illustrated and described in connection with example embodiments, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

I claim:

1. A vertical tunnel kiln that transmits parts downwardly for firing and removes volatiles by the exhaust of gases from the interior of said kiln, comprising a casing forming an interior core, a helical ramp extending from one end of said vertical tunnel kiln to an oppositely disposed end of said vertical tunnel kiln and providing a track adapted to receive said parts thereon which are subjected to temperature gradients as they progress downwardly from the upper to the lower end of said kiln, heating means for heating said kiln which receives and confines said heat to fire said parts, means forming interior baffles for controlling the movement of gases through said kiln and to effect preferred temperature gradients within said kiln as the parts on said track progressively advance from the upper to the lower end of said kiln, means for developing a vibratory force communicated to said track whereby the parts are successively advanced from the upper to the lower end of said kiln, feeder means for orienting and supplying said parts to the upper end of said track, and timed discharge means for controlling the discharge rate of said parts at the lower end of said kiln, whereby said interior baffle means controls the flow of gases through said kiln to effect an exhaust of volatiles from said kiln as said parts move downwardly through said temperature gradients and are fired.

2. The kiln in accordance with claim 1, wherein the heating means is disposed about the outer periphery of the kiln.

3. The kiln in accordance with claim 2, including means for heating the interior of said core whereby the heat developed within said kiln is provided both by interior and exterior core heating means.

4. The kiln in accordance with claim 1, wherein the timed discharge means selectively retains a lowermost part and thereafter discharges it at a controlled rate.

5. The kiln in accordance with claim 1, wherein said track comprises a chute which spirals about the outer periphery of said core, and the heating means comprises means for heating the interior of the core and heating means disposed radially outwardly of said track whereby heat is simultaneously generated interiorly and exteriorly of said core for heating parts as they progress along said chute.

6. A process for firing parts as they move downwardly through a vertical kiln and volatiles are removed by the exhaust of gases from said kiln, comprising the steps of: (a) feeding said parts to the upper end of a spiral chute disposed in said vertical kiln, (b) imposing a vibratory force on said chute whereby the parts are progressively advanced from the upper end of said kiln to the lower end thereof, (c) heating the interior of said kiln, (d) selectively locating baffle means in said kiln to control the upward movement of gases through said kiln and thereby confine the heat generated within discrete zones whereby temperature gradients are effectively controlled from the upper to the lower ends of said kiln and including a high temperature zone for firing said parts, (e) controlling the rate of advancement of said parts through said kiln whereby the parts are cooled sufficiently after high temperature firing, and (f) continuously controlling the rate of advancement of parts along said chute and the flow of gases through said kiln whereby the parts are fired and the exhaust of said gases removes said volatiles.

7. The process in accordance with claim 6, including the step of singularly feeding individual ones of said parts to the upper end of the spiral chute.

8. The process in accordance with claim 6, including the step of coordinating the vibratory force imposed on the chute and a part discharge rate whereby the parts are caused to reside in the respective zones within said kiln for controlled times and at controlled temperatures.

9. The process in accordance with claim 6, including the step of controlling the discharge of parts from said kiln by subjecting them periodically to controlled blasts of air which effect successively the retention and subsequent discharge from said chute.

10. The process in accordance with claim 6, including the step of coordinating the frequency of the vibratory force imposed upon said chute and the discharge rate of parts from the lower end of the chute to control the rate of advancement of parts along the chute.

11. The process in accordance with claim 6, wherein the parts are cooled sufficiently to preclude oxidation.

12. The process in accordance with claim 6, including the step of controlling the discharge rate of said parts from the lower end of said spiral chute.

13. The process in accordance with claim 6, wherein the exhaust of gases from said kiln removes said volatiles by convection while maintaining the temperature gradients within said kiln.

14. The process in accordance with claim 6, including the step of discharging said parts from the kiln at a rate of discharge that effects a constant load of parts passing through said kiln.

15. The process in accordance with claim 6, including the step of generating a temperature of at least 1,000° C. in the high temperature zone.

16. The process in accordance with claim 6, in which the number of parts moving through said kiln remains substantially constant and is characterized by parts progressing along said spiral chute in substantially an end-to-end relationship and each part subjected to the same range and time of heating.

* * * * *